US006089281A

United States Patent [19]

Anderson

[11] Patent Number: 6,089,281

[45] Date of Patent: Jul. 18, 2000

[54] STRAND GRIPPER AND METHOD

[75] Inventor: Douglas McArthur Anderson, Greenville, S.C.

[73] Assignee: Precision Research & Development, Inc., Greenville, S.C.

[21] Appl. No.: 09/292,438

[22] Filed: Apr. 15, 1999

[51] Int. Cl.[7] ..... D03D 47/20

[52] U.S. Cl. ..... 139/448; 139/447; 139/438; 139/196.2; 139/216; 139/293

[58] Field of Search ..... 139/438, 447, 139/448, 196.2, 216, 293

[56] References Cited

U.S. PATENT DOCUMENTS

| | | | |
|---|---|---|---|
| 2,728,359 | 12/1955 | Pfarrwaller | 139/127 |
| 2,845,095 | 7/1958 | Pfarrwaller | 139/127 |
| 3,072,155 | 1/1963 | Pfarrwaller et al. | 139/126 |
| 4,117,871 | 10/1978 | Burer | 139/448 |
| 5,441,086 | 8/1995 | Nanni | 139/196.2 |

*Primary Examiner*—John J. Calvert
*Assistant Examiner*—Robert H. Muromoto, Jr.
*Attorney, Agent, or Firm*—Ralph Bailey, P.A.

[57] ABSTRACT

A gripper for transporting filling yarn in a projectile (A) across a loom for insertion during weaving is carried by spring arms (B). The gripper includes opposed jaws one of which has a V-shaped inner surface (C) and the other jaw has a W-shaped inner surface (D) receiving an end of filling yarn (Y) when the gripper is closed. The method includes transporting the filling yarn across the loom while engaged by the opposed interengaging inner surfaces of the jaws.

5 Claims, 2 Drawing Sheets

STRAND GRIPPER AND METHOD

BACKGROUND OF THE INVENTION

This invention relates to a strand gripper and method and more particularly to an improved gripper for transporting filling yarn in a projectile across a weaving machine.

During the operation of high speed looms the filling, whether it be a strand of wire or of yarn, is gripped between a pair of spring biased jaws for transport across the loom through the warp shed for weaving. The forces exerted in order to achieve competitive speeds cause the filling to be pulled out of the gripper. The prior art relating to grippers is exemplified by the following U.S. Pat. Nos. 3,712,345, 3,853,152, 3,854,506, and 5,441,086 which are illustrative of projectiles for Sulzer Ruti weaving machines. It will be observed that the jaws each comprise flat opposing surfaces which are spring biased toward closed position by the action of spring arms which are joined at an end remote from the jaws for fixing them within the body of the projectile. The resilient action of the spring arms is often insufficient to exert a sufficient gripping action upon the filling or weft yarns.

Efforts have been made to improve gripping characteristics by providing irregular rather than smooth opposing jaw surfaces. Irregular surfaces have been knurled, grooved, undulated as well as lined with special material. Nevertheless, problems in achieving sufficient gripping force without damaging the strands have persisted.

SUMMARY OF THE INVENTION

Accordingly, it is an important object of this invention to provide a strand gripper capable of exerting a gripping action to meet the needs of high speed projectile-type weaving machines.

It has been found that an enhanced gripping action may be achieved by the jaws to hold the filling during a picking action of a loom. Included in the attempts to achieve a suitable texture for the inner surfaces of the jaws is the provision of characteristic serrations of knurled surfaces which have a tendency to damage the filling.

Accordingly, it is an important object of this invention to provide a gripping surface on the opposed jaws of a gripper within a projectile avoiding inner engaging flat surfaces. This is found to be best accomplished through the use of a generally V-shaped surface on one of the jaws with an inner engaging generally W-shaped interengaging inner surface of an opposing jaw. The legs of the V are suitably blunted as by generally flat upper surfaces while the middle leg of the W is also suitably blunted at its upper edge as by a generally flat surface. The strand is effectively gripped between the opposed interengaging V-surface and W-surface due to the effect of the changes in direction and increased engaging surface areas while avoiding damage to the strand itself. The V-shaped and W-shaped surfaces are preferred because sufficient reversal of direction is achieved to provide secure gripping while assuring sufficient engagement with the strand. If more interengaging surfaces are used greater expense would be incurred while space limitations may be exceeded with inefficient closure.

While the invention is described in the context of a projectile loom for weaving cloth with the insertion of filling yarn in a warp shed, the invention is useful in weaving wire strands so that the terms filling, strand and yarn are used interchangeably. The gripper of the present invention may have other usefulness in handling strands in addition to textiles and wire as well as in other contexts.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

A yarn gripper for use in a projectile A transported across a loom carrying filling yarn Y includes a pair of opposed spring biased arms B each having a free rearward end. A pair of opposed jaws are each carried by a respective free end. A V-shaped inner surface C is carried in one of the jaws, and a W-shaped inner surface D is provided in the other of the jaws opposite and in alignment with the V-shaped inner surface for interengagement receiving at least one end of filling yarn Y thereacross gripping the filling yarn within the inner surfaces when the jaws are closed for transport across a loom during weaving.

Figure 1:
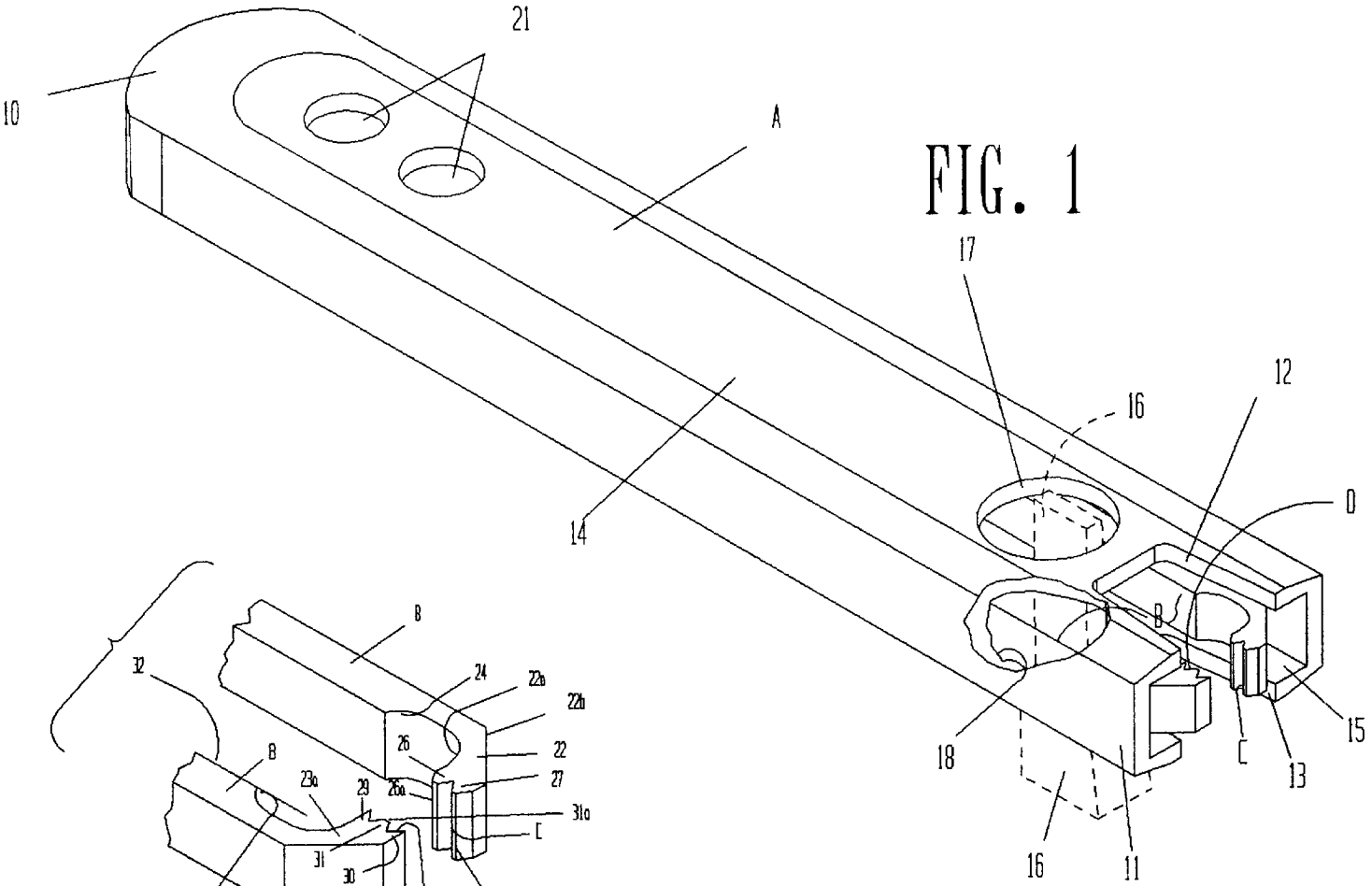
FIG. 1 is a left perspective view schematically illustrating a projectile carrying a gripper having opposed jaws constructed in accordance with the invention and illustrating a clamp opener in broken lines. Thus, the gripper jaws are opened for reception of a filling yarn from an exterior yarn package from which filling yarn may be suitably fed such as by a yarn feeder.
Figure 5:
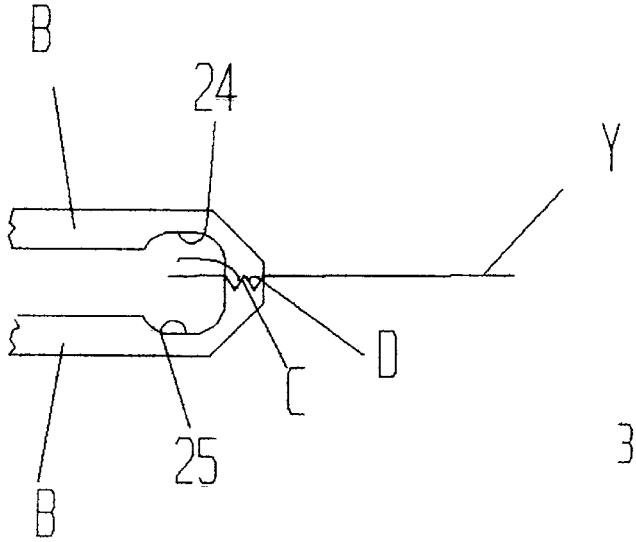
FIG. 5 is a top plan view illustrating the clamping jaws in closed position with the clamp opener removed to permit the resilient action of the spring arms to close the jaws to grip the filling yarn Y.

The projectile A is generally octagonal in shape having a forward end 10 and a back end 11. At the rear of the projectile a pair of opposed notches 12 and 13 define a relieved opening in upper and lower surfaces 14 and 15 of the projectile. The relieved opening is provided for facilitating reception of the yarn Y between the jaws as illustrated in FIG. 5. A conventional tapered clamp opener is illustrated in broken lines as at 16 in FIG. 1 for opening the legs B for reception of the yarn. The legs B are normally in a closed position due to the substantial force of the resilient action of the spring legs biased to closed position. The clamp opener 16 is illustrated as passing upwardly during weaving through an upper opening 17 in the upper surface 14 and a corresponding lower opening 18 in the lower surface 15 of the projectile.

Figure 2:
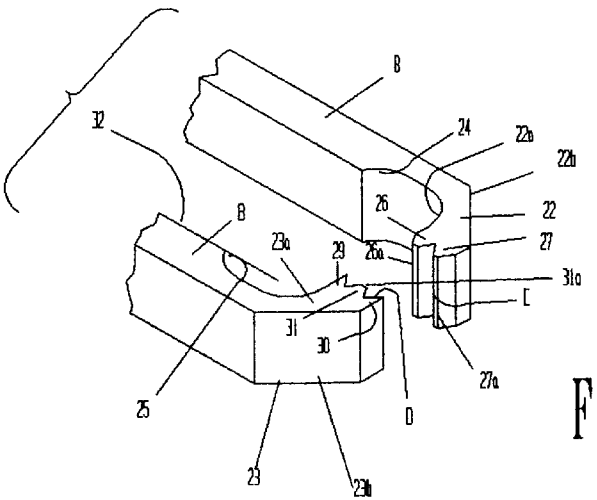
FIG. 2 is an enlarged perspective view further illustrating the gripper of FIG. 1.
Figure 3:
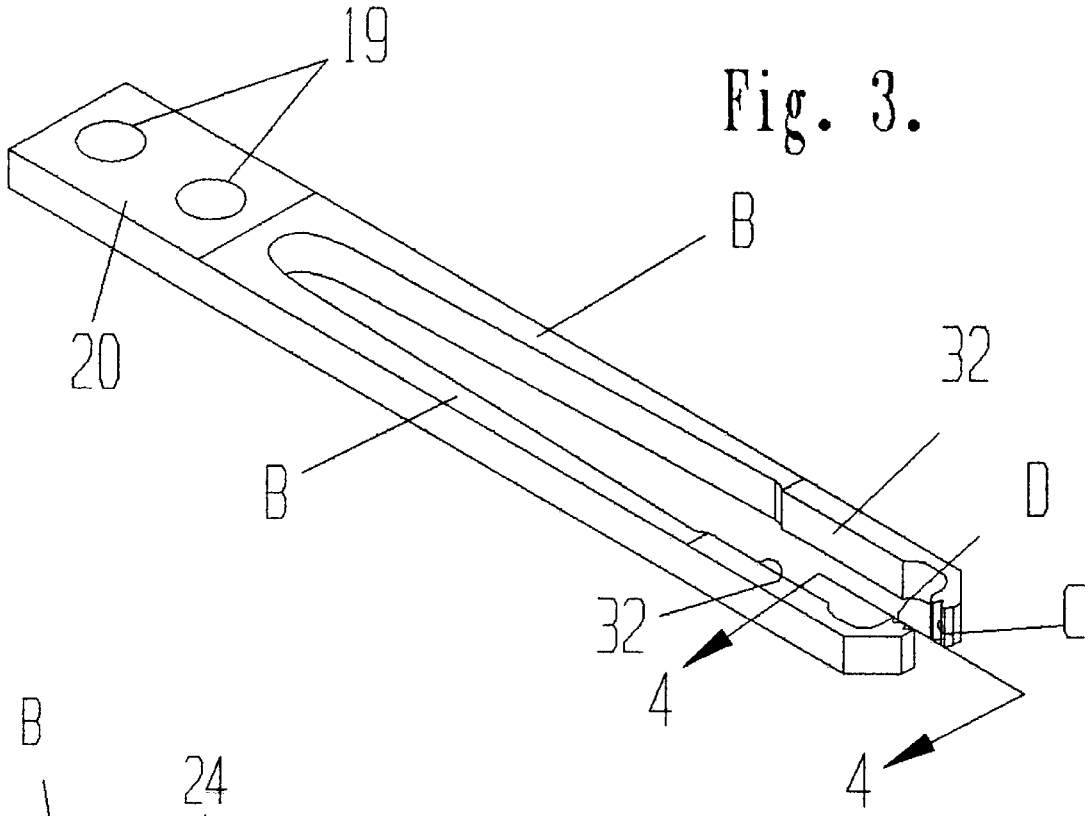
FIG. 3 is a perspective view illustrating the gripper including the spring arms joined at one end for mounting in the nose of the projectile with the gripper jaws on the other end for receiving a filling yarn from the yarn feeder.
Figure 4:
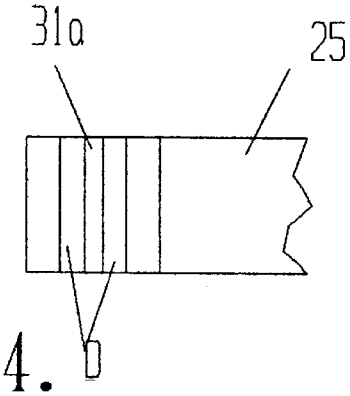
FIG. 4 is an enlarged front elevation taken along the line 4—4 in FIG. 3 illustrating the inner surface of the jaw having a W-shaped configuration.

The gripper spring is illustrated in FIG. 3 as removed from the projectile and has openings at 19 in an end member 20 which integrally joins the legs B. Suitable fasteners such as rivets 21 pass through the openings 19 for positioning the spring gripper in fixed position within the projectile. FIGS. 2 and 4 best illustrate jaws 22 and 23. An inner V-shaped surface C is illustrated in FIG. 2. A substantially W-shaped inner surface D is illustrated in FIGS. 2 and 4.

It will be observed that the jaws 22 and 23 are formed by rearwardly converging arms 22*a* and 23*a* defined by opposed arcuate indentations 24 and 25 as well as rearwardly and inwardly tapering surfaces 22*b* and 23*b*.

The substantially V-shaped inner surface C includes a pair of upright legs 26 and 27 in FIG. 2 which are formed by outwardly projecting surfaces which converge in upper flat surfaces 26*a* and 27*a* so as to blunt the V-shaped interengaging legs to afford greater gripping action while avoiding damage to the yarn.

The generally W-shaped inner surface D has three legs, two of which are exterior legs illustrated as at 29 and 30 while an interior leg is shown as at 31. The middle of these upright legs is blunted by a flat surface 31*a*. The inner leg 31 extends into the V-shaped surface C and thus interengages for exerting an improved gripping action upon the yarn Y as best illustrated in FIG. 5.

The opposed arcuate indentation forming members 24 and 25 join opposed thickened portions 32 on inner portions of the gripper arms B as best seen in FIG. 3. Those thickened portions accommodate the opener 16 for preparing the grippers for receiving and gripping yarn for a picking action of the weaving machine.

While a preferred embodiment of the invention has been described using specific terms, such description is for illustrative purposes only, and it is to be understood that changes and variations may be made without departing from the spirit or scope of the following claims.

What is claimed is:

1. A yarn gripper for use in a projectile transported across a loom carrying filling yarn comprising:

a pair of opposed spring biased arms extending in a direction of yarn travel across the loom and each having a free end;

a pair of opposed jaws each carried by a respective free end;

a V-shaped inner surface in one of the jaws extending across the direction of yarn travel and;

a W-shaped inner surface in the other of the jaws opposite and in alignment for receiving in interengaging relation the V-shaped inner surface for confining at least one end of filling yarn thereacross gripping the filling yarn within the inner surfaces when the jaws are closed for transport across the loom during weaving.

2. The yarn gripper set forth in claim 1 wherein the V-shaped inner surface and the W-shaped inner surface each have a flat apex surface.

3. The yarn gripper set forth in claim 1 wherein the inner surfaces are vertical with respect to the loom and extend entirely across respective jaws.

4. A strand gripper comprising:

a pair of opposed jaws;

a V-shaped inner surface in one of the jaws extending across a direction of yarn travel;

a W-shaped inner surface in the other of the jaws opposite and in alignment for receiving in interengaging relation the V-shaped inner surface for positioning at least one strand thereacross gripping the strand between the jaws when the jaws are closed.

5. The strand gripper set forth in claim 4 wherein the inner surfaces are aligned and extend entirely across the jaws for confining the strand within the inner surfaces.

* * * * *